US006893307B1

(12) United States Patent
Melius

(10) Patent No.: US 6,893,307 B1
(45) Date of Patent: May 17, 2005

(54) ERGONOMIC SWIM FIN APPARATUS

(76) Inventor: John David Melius, 2725 Vista Ct., Waldorf, MD (US) 20603

( * ) Notice: Subject to any disclaimer, the term of this patent is extended or adjusted under 35 U.S.C. 154(b) by 0 days.

(21) Appl. No.: 10/060,142

(22) Filed: Feb. 1, 2002

Related U.S. Application Data

(60) Provisional application No. 60/265,581, filed on Feb. 2, 2001.

(51) Int. Cl.[7] ..... A63B 38/11
(52) U.S. Cl. ..... 441/64
(58) Field of Search ..... 441/61–64

(56) References Cited

U.S. PATENT DOCUMENTS 3,107,372 A * 10/1963 Brown et al. ..... 441/64
5,041,039 A * 8/1991 Chang ..... 36/8.1
6,375,531 B1 * 4/2002 Melius ..... 441/56

FOREIGN PATENT DOCUMENTS

WO WO 01/85266 A2 * 11/2001

* cited by examiner

*Primary Examiner*—Sherman Basinger
(74) *Attorney, Agent, or Firm*—Donald Grant Kelly

(57) ABSTRACT

The ergonomic swim fin apparatus comprises a foot-pocket sized to fit about a user's foot, channeling scoops are positioned on opposite sides of the footpocket, and a flexible blade extends from the foot-pocket to a trailing edge. A "wing shaped" tail fin is secured to the trailing edge of the flexible blade. The channeling scoops are rounded to channel the water displaced by the user's foot over the flexible blade and tail fin. The flexible blade and wing like tail fin channel water while enhancing lift and thrust. At least one securing strap is used to secure the user's foot to the foot-pocket. The tail fin is preferably selectively attachable and removable from the distal end of the flexible blade. The flow of water across the foot is converted by the channeling scoops into a propulsion stroke in both the up and down strokes, while allowing the foot the freedom to flex naturally at the ankle and toe joints.

12 Claims, 7 Drawing Sheets

Figure 8
Prior Art
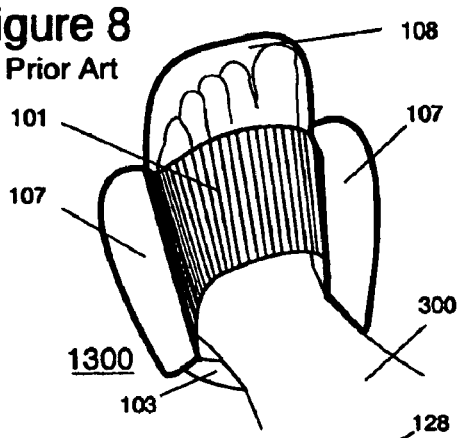
Figure 9
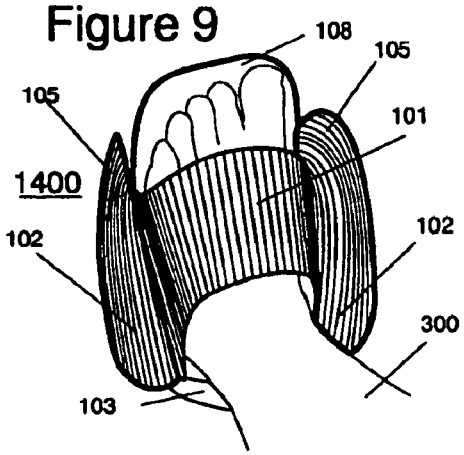
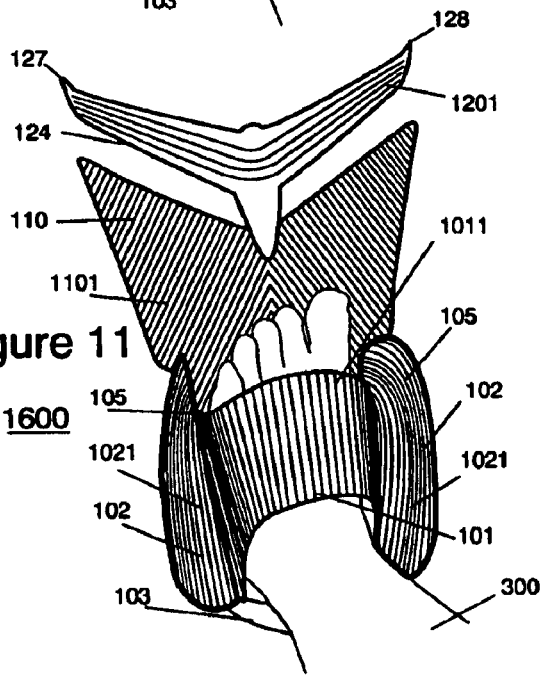
Figure 11
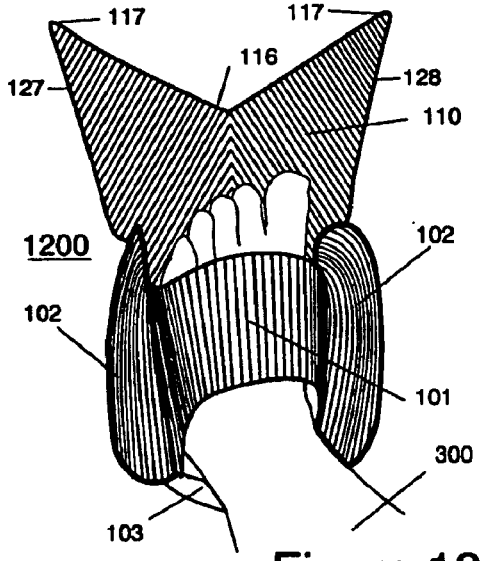
Figure 10
Figure 12
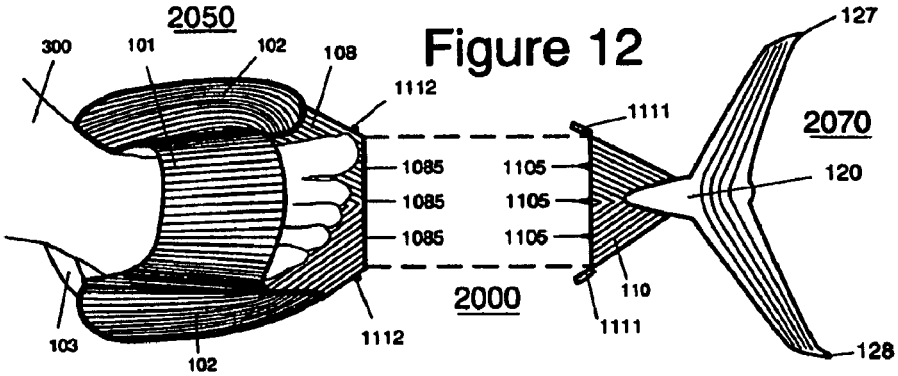

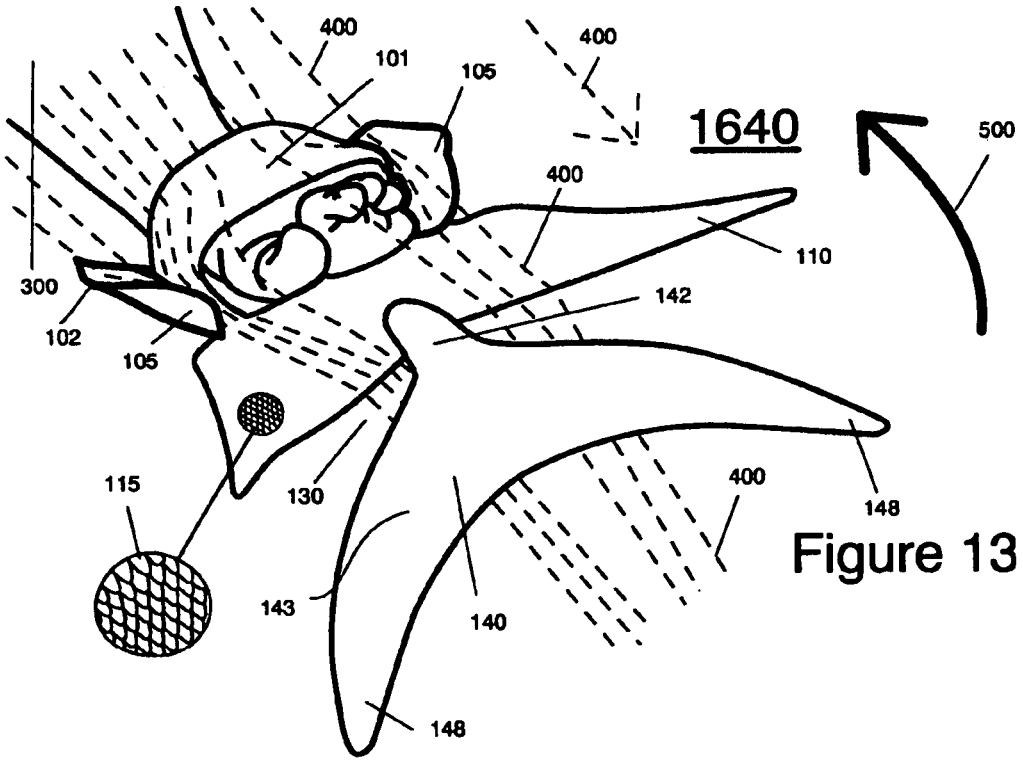
Figure 13
Figure 14
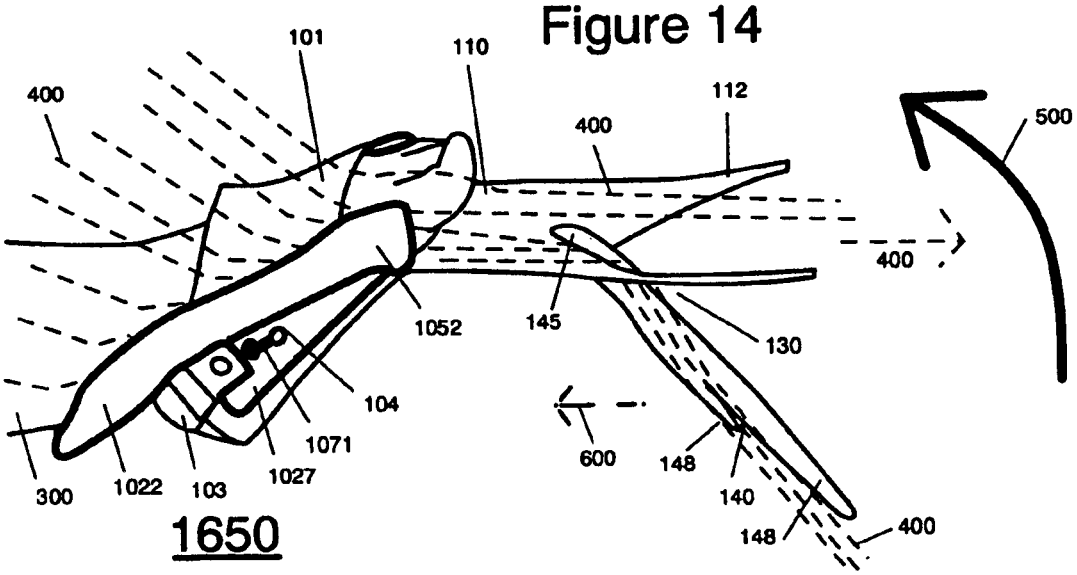

Figure 15
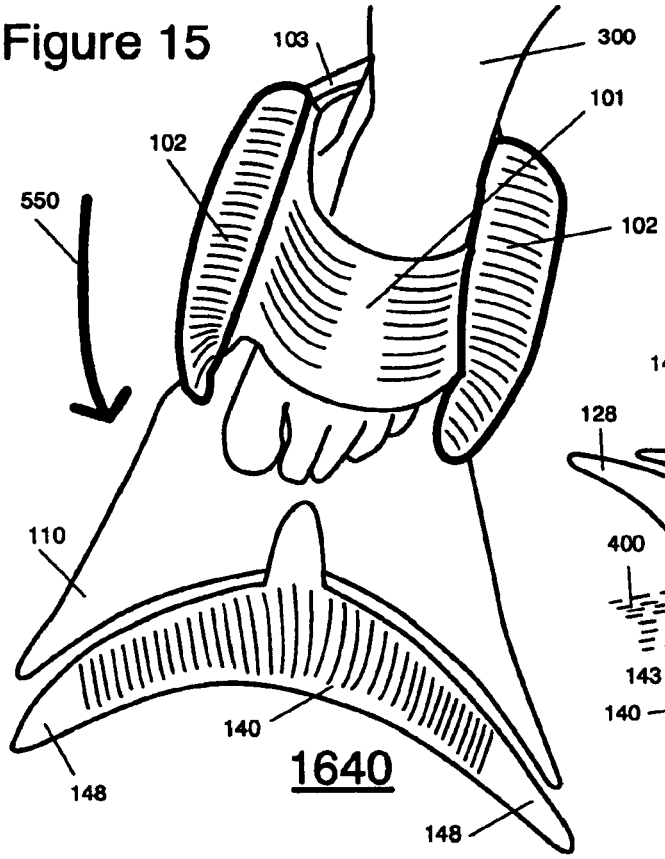
Figure 16
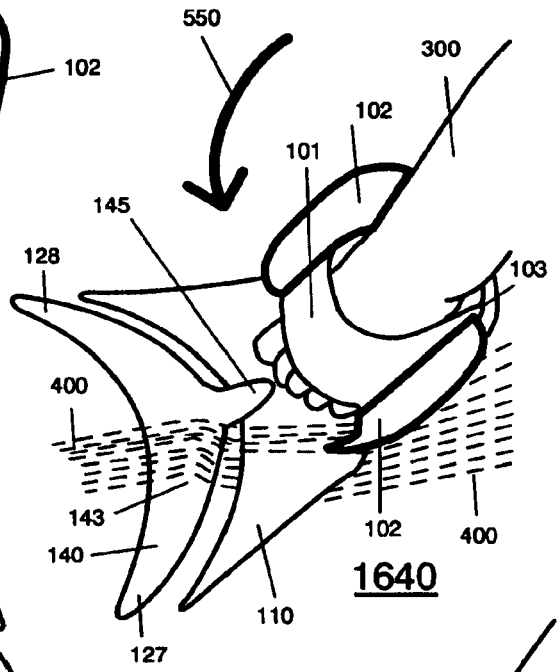
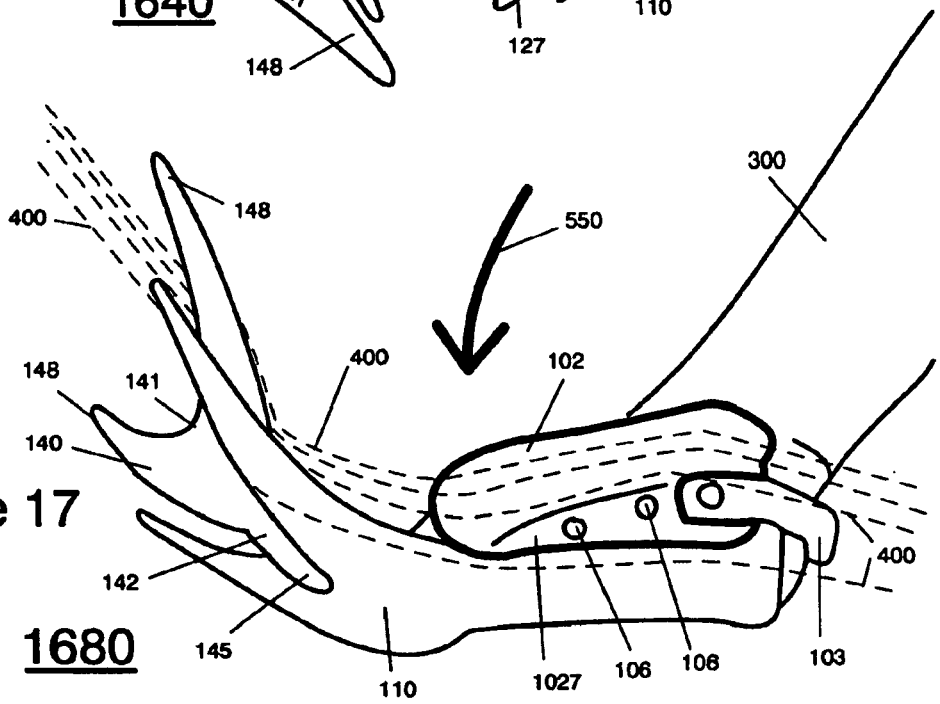
Figure 17

ERGONOMIC SWIM FIN APPARATUS

CROSS REFERENCE TO RELATED APPLICATIONS

This utility patent application claims priority of provisional patent Application 60/265,581 filed Feb. 2, 2001, which is incorporated by reference herein.

TECHNICAL FIELD

This disclosure relates to swim fins used for swimming underwater or at the surface, or as swim fins that can be worn with adapted footwear.

BACKGROUND OF THE INVENTION

This invention relates generally to the field of swimming and diving, and more particularly to an ergonomic swim fin apparatus based on the locomotion methods and strategies used by the most efficient fish. This invention can be assembled to various levels of complexity, to be used to swim at varying degrees of effectiveness and purpose. Much work has been done in recent years in biomimetics to study efficient swimming fish to try to effect a man-made free moving aquatic device that- approaches their propulsion, efficiency, acceleration and maneuverability. Universities such as MIT, Northeastern University, the University of Tokai, Japan, the Herriot-Watt University, Edinburgh, Scotland, Texas A&M University and Aeroprobe Corp., and the University of New Mexico and Artificial Muscles Research Institute are all researching various aspects of this propulsion system, as described in U.S. Pat. No. 6,138,604 and other publications. Scientific analyses developed from free swimming fish and robotic models of fish have been directed towards the development of a pelagic free swimming aquatic vehicle. In the instant invention, applicable principles that parallel these biomimetic studies have been adapted to create a swim fin apparatus that is created for ergonomic human swimming, underwater or at the surface, that will imitate fish and their propulsion, efficiency, acceleration and maneuverability. This swim fin apparatus also allows the swimmer to adapt to various swimming conditions and swimming goals by allowing certain elements of the apparatus to be selectively interchanged to meet these goals. This apparatus also provides an elegant solution for non-swimming problems associated with the general use of swim fins, such as: walking with the swim fins, an easy method for manufacture of said swim fins, and solutions for sore tendons produced by swimming with past swim fms.

A few attempts, most notably U.S. Pat. Nos. 2,423,571; 2,950,487; 4,934,971 and 5,906,525; have attempted to deal with the fish propulsion problem by focusing on moving a portion of a swim fin which has been shaped like a fish or dolphin tail fin or a variation or such. Simply moving a tail fin through the water (without a flow of water over a "lifting" surface at a correct angle of attack) produces a flopping form with little or no propulsion. At best, the tail fin in this system acts like a webbed foot, with its associated problems.

U.S. Pat. No. 2,099,973 comes close to adapting the propulsion system of efficient fish type propulsion, but has several inherent problems. First, it employs an upper stiff paddle that has no shaped foot pocket and does not let the toes flex. This would be uncomfortable to use when swimming or walking, because the toes would continually be constricted and under substantial pressure. Second, the lack of a formed foot pocket would cause pressure points on of the top of the user's foot. Third, the flat stiff paddle does nothing to enhance or channel the flow of water over the fin to enhance propulsion. Finally, this patent doesn't include a tail fin that gives "lift" to the propulsion system for increased power and efficiency, as is found with fish propulsion systems.

U.S. Pat. No. 6,375,531 granted to the present inventor comes the closest to adapting the system used by fish for propulsion. It uses a stiff flat blade for propulsion, a flexible portion, and a"wing shaped" tail to provide lift. It is a very effective form of locomotion that fulfills all of the requirements for effective fish propulsion system, but it is not as ergonomic in its design with regard to the human foot and anatomy, as is the present invention. The invention described in U.S. Pat. No. 6,375,531 uses a stiff blade that extends beyond the toes which creates unnecessary work and undue pressures on the foot of the swimmer, and makes walking in the fins very difficult. Secondly, the invention described in U.S. Pat. No. 6,375,531 requires more material in the production of the swim fin than required by a swim fin disclosed in the present invention, because the swim fin described in the latter-noted patent must be longer and heavier than the present embodiment shown in FIG. 1, 5, 11, 12 and 15, to produce similar propulsion results.

The vast majority of prior art swim fins have functioned as webbed feet or paddles. Webbed feet and paddles work to push water, but not as efficiently as the propulsion system used by fish. Two clear problems with webbed feet and paddles are that water isn't pushed effectively, and a recovery stroke is required to arrive at a position to properly push on each stroke of the swim fins (a substantial waste of energy and a cause of drag.)

The numbers of patents using the "webbed foot" or "paddle" form of propulsion are too numerous to mention. A selected number of them are mentioned because of their historical importance or superficial resemblance to the instant invention. Each of these prior art patents, simply increase the surface area for pushing water, and they include:

U.S. Pat. No. 74,931, issued in 1868, which the earliest known patent in this art, in which the webbed foot concept is extremely clear, with elongated forms of the toes and fingers which are webbed with cloth.

U.S. Pat. No. 169,396, issued in 1875, is a series of hinged flaps and other forms positioned above the surface of the foot.

U.S. Pat. No. 281,005, issued in 1883, utilizes hinged flaps connected to the bottom of a shoe form.

U.S. Pat. No. 335,015, issued in 1886, is an ingenious system of retractable flaps positioned at the sides and front of the foot.

U.S. Pat. No. 636,364, issued in 1899, is a form of swim fin worn with a shoe that would balloon out in the backward kick to increase the surface area.

U.S. Pat. No. 1,113,820, issued in 1914, disclosed hinged flaps positioned above a shoe.

U.S. Pat. No. 1,187,963, issued in 1916, disclosed hinged flaps above and to the sides of a shoe.

U.S. Pat. No. 1,374,077, issued in 1921, disclosed swim fins having a single flat surface supported above the shoe that did not move.

U.S. Pat. No. 1,571,462, issued in 1926, disclosed swim fins having an increased surface area, with a wire form on the sides and front of the foot that incorporated a cloth spread under the foot to encompass the wire form.

U.S. Pat. No. 1,729,477, issued in 1929, discloses swim fins with wire forms and cloth, to create a larger form above the shoe.

U.S. Pat. No. 1,788,013, issued in 1931, professes to "provide a device similar in form to the webfoot of a water bird", with a web form attached to the bottom of a bathing shoe.

U.S. Pat. No. 1,911,828, issued in 1933, attaches two hinged fin forms horizontal to the floor to a shoe to create moveable swim fin flaps.

U.S. Pat. No. 2,277,538, issued in 1942, employs swim fins having two hinged flaps attached to a shoe that meet at the top of the shoe.

U.S. Pat. No. 2,672,629, issued in 1954, traps water by a system of wire supports and cloth webbing that surrounds the sides and front of the foot. A small amount of flexibility is provided in the toe portion of the wire supports and webbing.

U.S. Pat. No. 5,795,204, issued in 1998, extends the area of swimming shoes by providing a semi-flexible swim fin flap extending from the bottom of the shoe to the outside side of the foot, which does not extend beyond the toes of the shoe.

Other swim fin designs have tackled design problems along with the problem of propulsion. These patents are representative of many others, dealing with common problems in manufacturing or common usage of the swim fins. U.S. Pat. No. 3,315,286 describes a swim fin that has a hinged swimming blade that enables the swimmer to walk easily while wearing the swim fins. Other known swim fin swivel systems have been developed to aid walking. U.S. Pat. No. 5,597,336 describes a swim fin with an open instep instead of a closed foot pocket, which discloses a simple two piece mold, for use in swim fin production. U.S. Pat. No. 5,975,973 employs an asymmetrical swim fin design that promotes a small amount of rotation while swimming to decrease tendon soreness due to swimming with swim fins.

BRIEF SUMMARY OF THE INVENTION

The channeling scoop of the present swim fin apparatus is the fundamental element that provides initial propulsion and can be used with traditional swim fins, or with other specially adapted footwear such as sandals or shoes. Because the prerequisite stiff element of the swim fin is located on either side of the foot instead of in front of the toes, the pressures produced from swimming are spread over the entire surface of the foot.

Channeling scoops are located between the flexible joints of the foot (the ankle and toes), and allow the swimmer substantially freer movement, and improve the ease of walking while wearing the swim fin apparatus disclosed herein. The channeling scoops can be used with traditional swim fin forms, and are preferably rounded to channel the water displaced by the user's foot. The present invention is easier and more efficient to use without any loss in propulsion even though the overall length of the swim fin can be substantially shortened. The use of the channeling scoops enable the capturing of energy used to move the foot through the water (which usually slides off the sides of the foot.)

The present invention also utilizes a flexible blade and symmetrical wing fin. The flexible blade and wing fin enhance and channel water flow from the flexible blade, and channel the flow of water further, while creating lift with the wing-like tail fin.

This invention results from the realization that a truly effective swim fin apparatus is a highly efficient form of propulsion for a human while swimming underwater or near the surface of the water. This can be achieved with a semi-rigid foot pocket or specially adapted shoe employing channeling scoops that convert the flow of water across the foot into a propulsion stroke, while allowing the foot the freedom to flex naturally at the ankle and toe joints.

The foot pocket is preferably connected to a flexible blade, which is configured to shape and channel the water across a symmetrical wing-shaped tail fin to provide additional propulsion through lift. The channeling scoops impel the foot to an optimum position during swimming and are preferably removable to selectively increase or decrease the speed and work output of the swimmer.

It is therefore an object of this invention to provide an improved swim fin apparatus having a foot pocket.

It is also an object of this invention to provide channeling scoops on each side of a user's foot to increase propulsion.

It is a further object of this invention to provide a swim fin apparatus utilizing a combination foot pocket, channeling scoops, a symmetrical flexible blade and wing fin extending beyond the profile of the flexible blade.

It is yet another object of this invention to channel water flow from the flexible blade to a symmetrical wing fin, to create additional lift.

These and other objects, features and advantages will be better understood from the following description of the preferred embodiments of this invention, when taken in conjunction with the following drawings.

BRIEF DESCRIPTION OF THE SEVERAL VIEWS OF THE DRAWINGS

FIG. 8 is a perspective view of a prior art swimming shoe.

FIG. 9 is a perspective of an embodiment of this invention, where a sandal type of shoe is equipped with channeling scoops, to aid in swimming.

FIG. 10 is a perspective view of an embodiment of this invention, with a combination foot pocket, channeling scoops, and a flexible blade.

FIG. 11 is a perspective view of an embodiment of this invention, with a combination foot pocket, channeling scoops, and a flexible blade, and a tail fin.

FIG. 12 is a perspective view of an embodiment of this invention, with a combination foot pocket, channeling scoops, with a selectively removable flexible blade and a tail fin. The tail fin and the flexible blade can be selectively removed or reassembled at will, for ease of transport or storage.

FIG. 13 is a perspective view of an embodiment of this invention, shown in an up-stroke motion, demonstrating the flow of water across the swim fin in dashed lines. An enlarged view shows the use of texture on the flexible blade.

FIG. 14 is a side view of an embodiment of this invention, shown in an up-stroke motion, with the flow of water across the swim fin shown in dashed lines.

FIG. 15 is a top view of an embodiment of this invention illustrating the flexible and stiff parts of the swim fin, when used in a down-stroke motion while swimming.

FIG. 16 is a top view of an embodiment of this invention, demonstrating the down-stroke motion, with dashed lines showing the flow of water across the swim fin surface.

FIG. 17 is a side view of an embodiment of this invention, demonstrating the down-stroke motion, with the flow of water across the swim fin surfaces shown in dashed lines.

DETAILED DESCRIPTION OF THE INVENTION

Figure 1A:
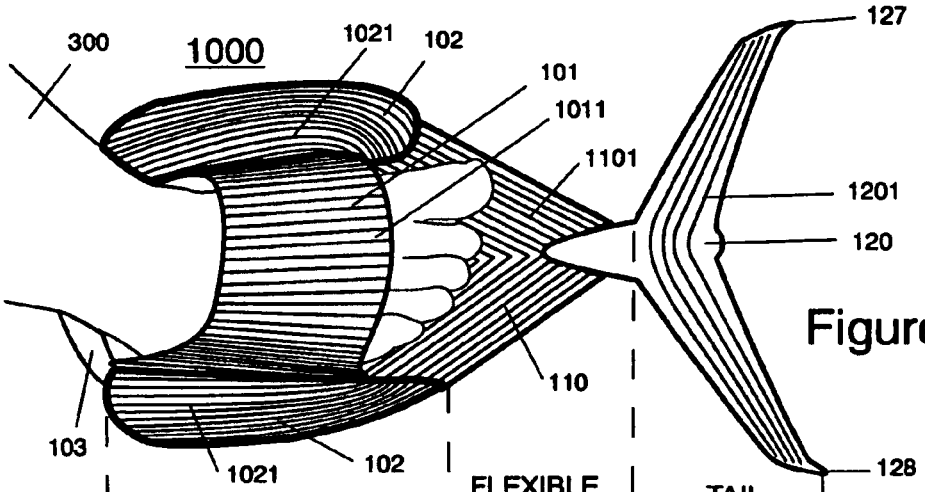
FIG. 1A is a perspective view of one embodiment of this invention, illustrating a swim fin apparatus with channeling scoops, a flexible blade, and a tail fin.

FIG. 1A shows a top view of the swim fin apparatus 1000 of the present invention. The user's leg and foot 300 is inserted into the foot-pocket 101 and held in place by a securing strap 103 which extends behind the user's heel. The foot-pocket 101 can be made of a waterproof, semi-flexible material such as polyurethane, plastic or rubber. Preferably, the foot-pocket 101 is resilient and flexible, to conform to the user's foot. Channeling scoops 102 are positioned one each side of the foot-pocket 101, and the channeling scoops 102 are preferably more rigid in construction than the foot-pocket. The channeling scoops 102 are preferably made of a different material than the foot-pocket 101. However, the channeling scoops 102 may alternately be made of the same material used for the foot-pocket 101.

Figure 1B:
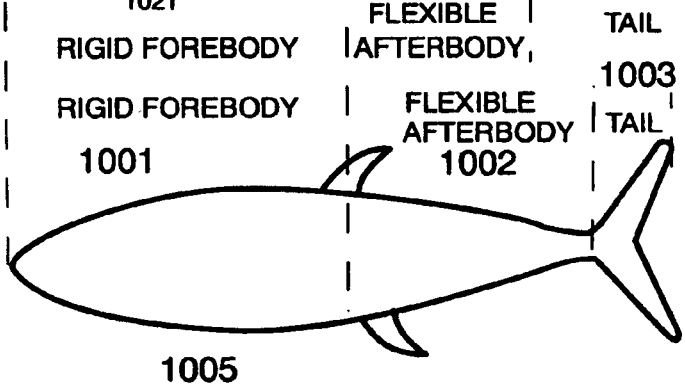
FIG. 1B is a diagrammatic side elevational view of a pelagic free swimming aquatic vehicle as disclosed in U.S. Pat. No. 6,138,604, for comparison of the principles of swimming, utilizing the propulsion system of fish.

As shown in FIG. 1B, the channeling scoops 102 preferably constitute the "RIGID FOREBODY" 1001 of the swim fin apparatus 1000. This ergonomic swim fin apparatus 1000 uses the foot-pocket 101 and the channeling scoops 102 to form the main thrust of the propulsion system. This thrust, together with the vortices created by this thrust, are shaped and enhanced by the "FLEXIBLE AFTERBODY" 1002 which is formed by the flexible blade 110. Finally, the tail fin 120, or "TAIL" 1003, enhances propulsion by creating "lift" from the channeled and enhanced water flowing over it at a proper angle of attack, as shown in dashed lines in FIG. 13 and FIG. 14.

In addition to providing an extremely efficient powerful swimming stroke for propulsion during swimming, the channeling scoops 102 also impel the swimmer to position the user's feet in the most advantageous position for each swimming stroke movement. This embodiment of swim fin apparatus 1000 can be manufactured from dissimilar materials and assembled into the embodiment shown in FIG. 1, or manufactured from a single material created as a single unit, to suit manufacturing preference.

This drawing also shows small grooves, foot pocket grooves 1011, flexible blade grooves 1101, channeling scoop grooves 1021 and tail fin grooves 1201, in the surface of the swim fin apparatus 1000 to enhance the production of vortices during swimming. These small foot pocket grooves 101, flexible blade grooves 1101, channeling scoop grooves 1021, and tail fin grooves 1201 imitate the scales and small grooves found on the skin and fins of some fish. It is speculated that these small vortices act as small "ball bearings" which serve to reduce drag. These small foot pocket grooves 1011, flexible blade grooves 1101, channeling scoop grooves 1021 and tail fin grooves 1201 are not essential to the function of this swim fin apparatus 1000, and the swim fin apparatus 2000 disclosed herein. The swim fin apparatus 2000 may alternately be provided with smooth surfaces. The surface of the swim fin apparatus 1000 may also be textured in a manner shown in FIG. 13, to simulate fish scales. These foot pocket grooves 1011, flexible blade grooves 1101, channeling scoop grooves 1021 and tail fin grooves 1201 enhance performance, but may be eliminated, should they cause difficulty in manufacturing.

FIG. 1B shows a second diagrammatic side view of a pelagic free swimming aquatic vehicle 1005, disclosed in U.S. Pat. No. 6,138,604, which illustrate some features of the scientific research being done at major Universities such as MIT and others. Although this work is the study of aquatic vehicles, instead of swim fins, much of the information in these studies parallels the conclusions that are reached in this ergonomic swim fin apparatus 1000. Note the similarity of the "RIGID FOREBODY" 1001, "FLEXIBLE AFTERBODY" 1002, and the symmetrical "TAIL 1003 shown in the preferred embodiment of this invention, and U.S. Pat. No. 6,138,604 shown in FIG. 1B. In FIG. 1, the toes on the leg and foot 300 illustrate that there is a left side 127 and a right side 128 of the tail fin 120 which are equal in size thus making them symmetrical in this swim fin apparatus 1000. The research in U.S. Pat. No. 6,138,604 suggests that the "RIGID FOREBODY" should constitute 40% to 80% of the proportion of the aquatic vehicle 1005. In research done on prototypes of this swim fin apparatus 1000, these figures are proven true.

Although there are many differences between the two areas of research, many parallels may be drawn, since both are based on the biomimetics of the swimming system employed by fish.

Figure 2:
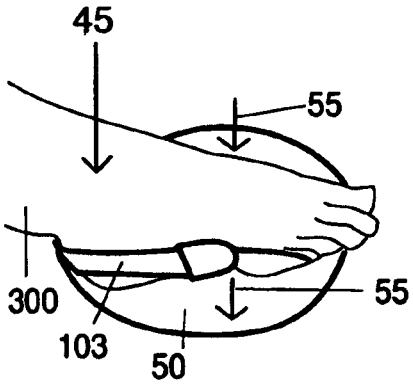
FIG. 2 is a perspective drawing of a stiff foot plate located between the ankle and the toe of a swimmer's foot.
Figure 3:
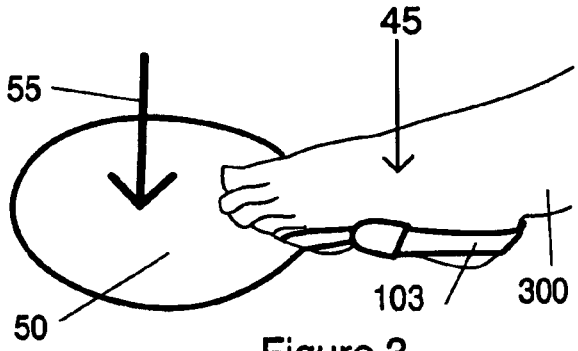
FIG. 3 is a perspective drawing of a stiff foot plate extending from the toe out away from the foot, as commonly practiced in the prior art.

FIG. 2 and FIG. 3 illustrate the differences in mechanical and ergonomic (less stress on the leg and foot 300) advantages by moving the stiff foot plate 50, "the Paddle", of the swim fin closer to the heel of the foot. FIG. 2 represents the swim fin apparatus 1000 presented in the present patent application, and FIG. 3 shows the methods used by the vast majority of swim fins in operation at present.

As shown in FIG. 2, the part of the swim fin that causes the water to move initially in the swimming stroke, the stiff foot plate 50, is placed between the heel and toe of the foot. This represents, in a simplified form, the corresponding foot-pocket 101 and channeling scoops 102 found in FIG. 1.

The swim fin apparatus shown in FIG. 3, positions the one end of the stiff foot plate 50 in proximity to the toes, and the opposite end extends beyond the toes. This represents the prior art swim fins, as shown in FIG. 4, FIG. 5, FIG. 6, and FIG. 7.

As shown in FIG. 2 and FIG. 3, the area enclosed in the stiff foot plate 50 is the same, and the leg and foot 300 are held to the stiff foot plate 50 by a securing strap 103. The forces 45 pushing down on the leg and foot 300 as it is moved through the water is the same in both cases no matter where the stiff foot plate is located, because the area of the leg and foot 300 is the same. The area occupied by the leg and foot 300 overlaps in the area of the stiff foot plate 50 as shown in FIG. 2, and therefore exposes less area to water pressure 55 than in FIG. 3.

Considering the round form of the top of the leg and foot 300, the force 45 that would be exerted against it would not produce much propulsion because the water would simply run around the leg and foot 300. But the water running around the leg and foot 300 in FIG. 2 would be caught and used in propulsion by the stiff foot plate 50. A second consideration for having the stiff foot plate 50 closer to the body is that it takes less energy to move a force that is closer because there is less centrifugal force without the lever arm added by distance from the power source (in this case the leg and foot 300.)

A third advantage to moving the stiff part of the swim fin between the heel and the toes of the foot is that the foot can flex naturally at those joints (making this kind of design more ergonomic), and cannot easily flex when the stiff foot plate 50 extends beyond the toes.

Figure 4:
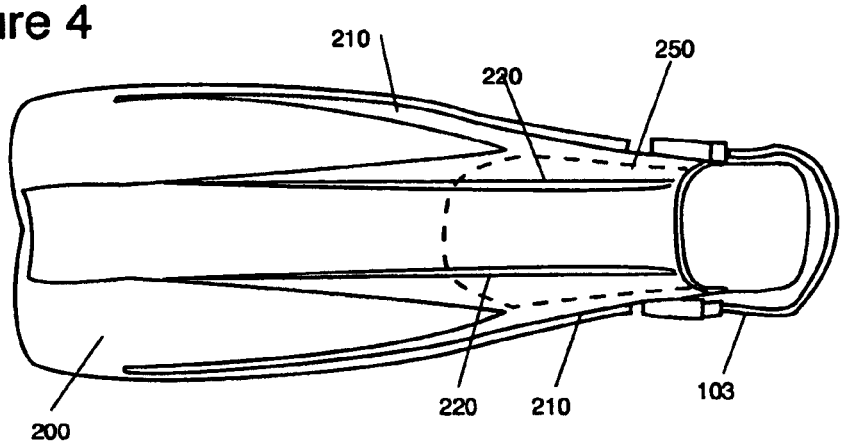
FIG. 4 is a plan drawing of a typical prior art swim fin utilizing extended stiffening ribs.

As shown in FIG. 4, a standard swim fin found in the prior art places the foot of the swimmer into the foot-pocket 250 of the swim fin, where it is held by the securing strap 103. Starting about midway on either side of the foot-pocket 250 there are reinforcing ribs 210. These reinforcing ribs 210 help to stiffen the prior art swim fin 200 (and act like a stiff foot plate or paddle.) A second internal set of reinforcing ribs 220 adds more reinforcement and stiffening to the swim fin 200. This combination of reinforcing ribs (although stiffening can be created by simply increasing the thickness of the material of the swim fin 200) provide the prerequisite stiffness to the swim fin 200. One can image that without this stiffness, the swim fin would have as much influence in swimming as an old pair of jeans tied to your feet (all drag and no propulsion.)

Figure 5:
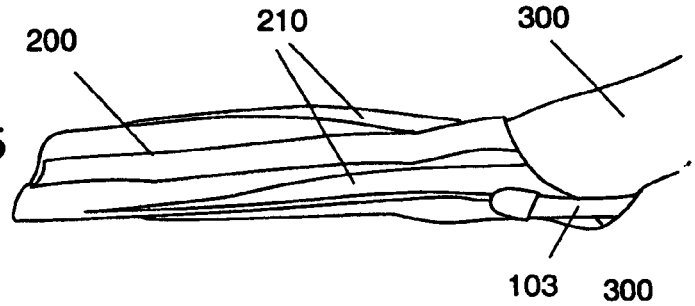
FIG. 5 is a perspective drawing of the prior art swim fin shown in FIG. 4, with the swim fin shown in a neutral position.
Figure 6:
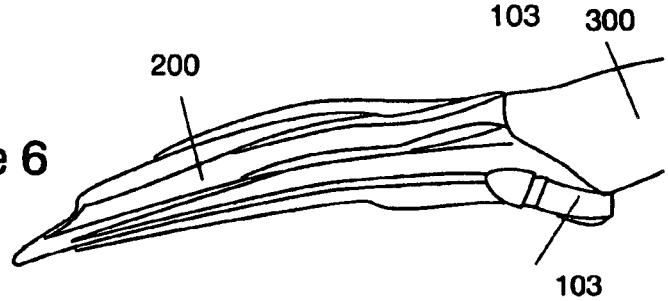
Prior Art Figure 6
FIG. 6 is a perspective drawing of the prior art fin shown in FIG. 4, with the swim fin shown in a slightly flexed position.

As shown in FIG.5, the reinforcing ribs 210 can be seen in a side perspective view of the swim fin 200, in an at rest position. FIG. 6 shows that the stiffness of the prior art swim fin 200 extends from the foot-pocket and well beyond the footpocket into the prior art swim fin 200 during normal use in swimming.

Figure 7:
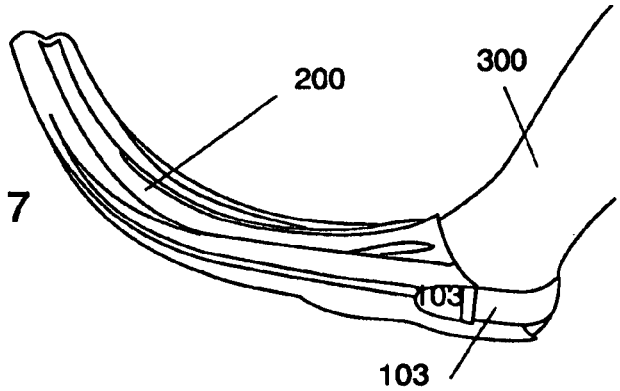
FIG. 7 is a perspective drawing of the prior art swim fin shown in FIG. 4, with the swim fin shown in a maximum flexed position.

FIG. 7 shows the maximum amount of flex that can be expected in prior art swim fins 200 during a down-stroke, with the stiff portion of the fin usually extending one half to two thirds of the overall distance of the swim fin 200. This stiff confinement of the toes and their joints means that walking in these prior art swim fins is exceptionally difficult and unnatural. It also causes cramps and soreness in the user's feet, and tendon soreness.

FIG. 8 represents the type of swim sandal/shoe 1300 that is found in the prior art. It generally used hinges on the flaps 107, and the flaps were placed horizontally to the ground. This would allow the flaps 107 to extend when the foot is pushed down in a swimming stroke. They would fold down to decrease resistance when the foot was raised towards the body during swimming. This had the advantage of giving more surface area against the water for the foot to push against, and it did let the foot bend and move at the toes (in more enlightened cases). The hinges did nothing to channel the flow of water in a desired direction, in order to increase propulsion. It only had an effect in the down stroke of the swimming cycle.

FIG. 9, FIG. 10, FIG. 11 and FIG. 12 show several embodiments of the present ergonomic swim fin apparatus 1400, 1200, 1600, and 2000 respectively.

In FIG. 9, the flaps 107 found in the swimming sandal/shoe 1300 of FIG. 8 are changed to channeling scoops 102. The channeling scoops 102 may be made of metal, plastic or rubber, etc. The swimming sandal/shoe/ swim fin apparatus 1400 is preferably made of any suitable waterproof material normally used for shoes or swim fins.

The channeling scoops 102 are curved surfaces that can either be fixed permanently or applied to a sandal or shoe when needed for swimming. These channeling scoops 102 are placed at an appropriate angle along the side of the sandal, shoe, or short swim fin, to channel the water running off of the top and the bottom of the foot. The channeling scoops 102 direct the water flow in a desired direction, during both the up and down stroke in swimming, as best shown in dashed line in FIG.13, FIG. 14, FIG 16 and FIG.17.

Preferably, the channeling scoops 102 are upwardly inclined along each side of the sandal, shoe, or short swim fin, from proximity to the user's toes to the user's heel.

These channeling scoops 102 may seem like a small change from a flap 107 found in FIG. 8, but because of their complex curved shapes 102 and directional channeling curves 105 their influence in the generation of propulsion is exceptional and unexpected. The channeling scoops 102 begin propulsion by angling the foot into the proper disposition in the water, and then channel the flow of water away from the swimmer creating unexpected thrust with tremendous efficiency, and maneuverability.

The channeling scoops 102 allow footwear as small as sandals, shoes, or short swim fins to be used as effectively as swim fins found in the prior art. The channeling scoops 102 also allow the user to use sandals or shoes as beach or general footwear because they allow the foot to flex normally and don't have protruding elements extending in front of the user's toes. The flexible blade sole 108 of the swimming sandal/shoe/short swim fin apparatus 1400 is preferably made of a comfortable material for standing and walking, but sturdy enough to withstand the pressures of walking and swimming.

To enhance the flow of water over the swim fin apparatus 1000, a flexible blade 110 is preferably secured to the swim fin apparatus 1000. The flexible blade 110 is symmetrical in FIG. 10, the toes on the leg and foot 300 illustrate that there is a left side 127 and a right side 128 of the flexible blade 110 which are equal in size thus making them symmetrical in swim fin apparatus 1200, and extends symmetrically and outwardly from the channeling scoops 102, in proximity to the user's toes. The flexible blade 110 pushes off of the rolling vortices of water produced by the foot-pocket/sandal/shoe and the channeling scoops 102. In the embodiment shown in FIG. 10, the blade tips 117 and centrally positioned channeling groove 116 also help to channel the water into a vector flowing away from the center of the flexible blade 110.

FIG. 11 shows the addition of a tail fin 120, which is selectively releasably secured to the centrally positioned channeling groove 116. The tail fin 120 provides a lifting surface in the embodiment of a swim fin apparatus 1600, shown in FIG. 11. This tail fin 120 adds to the efficiency and ease of the swimming stroke when water is channeled over the tail fin at a proper angle of attack. The water flows over the tail fin as shown in dashed lines in FIG. 13, FIG.14, FIG.16 and FIG. 17.

Note that the tail fin grooves 1201 extend parallel to the leading edge 124 of the tail fin 120. Similar types of tail fin grooves 1201 are found on the tail fin of Marlin fish. In the ergonomic swim fin apparatus 1000 disclosed herein, the tail fin grooves 1201 interact with the vortices caused by the channeling scoops 102, foot-pocket 101, and flexible blade 110.

FIG. 12 illustrates an embodiment 2000 of the swim fin apparatus that has many of the traits of the swimming sandal/shoe/short swim fin apparatus 1400 found in FIG. 9. The swim fin apparatus 2000 contains a foot-pocket 101, opposing channeling scoops 102 located on opposite sides of the foot-pocket 101, the flexible blade sole 108, and at least one securing strap 103.

In this embodiment, the symmetrical flexible blade sole 108 is detachable from the flexible blade 110, and may be selectively attached and removed, for ease of shipping and handling. By providing a releasable attachment means such as a hook 1112 and catch 1111 at the toe end of the flexible blade sole 108, the distal end of the flexible blade 110 is removable, enabling the user to easily walk on land, without removing the entire swim fin apparatus.

The releasable attachment means such as a hook 1112 and catch 1111 preferably comprises a complimentary hook 1112 and catch 1111 means. In the embodiment shown in FIG. 12, the hook 1112 is located on each side of the flexible blade sole 108, in proximity to the toe end of the footwear assembly 2050. The distal end of the footwear assembly 2050 preferably includes at least one aperture 1085 sized to closely receive at least one complimentary pin or cone 1105, located on the removable end of the tail fin assembly 2070 on the flexible blade 1110. The combination pin and complimentary aperture 1105, 1085 serve to align and position the footwear assembly 2050 in relation to the removable tail fin assembly 2070.

Preferably three apertures 1085 and three pins 1105 are used to position and align the distal end of the tail fin assembly 2070 in relation to the footwear assembly 2050. As shown in FIG. 12, the symmetrical tail fin assembly 2070 is releasably secured to a central portion of the distal end of the tail fin assembly 2070 and the distal end of the footwear assembly 2050 of the swim fin apparatus 2000.

Figure 24:
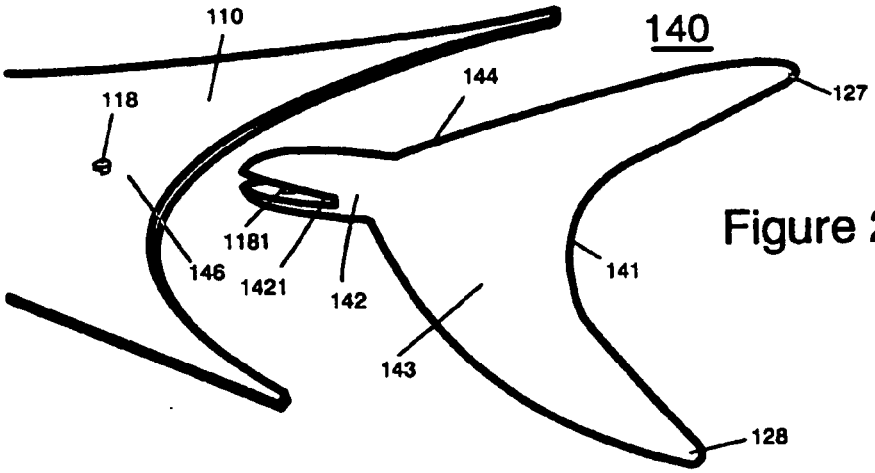
FIG. 24 is a partial rear view of an embodiment of this invention, wherein a portion of the symmetrical flexible blade is shown with a non-connected tail fin, which is selectively connected for use, and disconnected for ease of shipping and storage.

The tail fin 140 is preferably symmetrical because the right side 128 and the left side 127 are equal in size and shape as seen in FIG. 24. The tail fin 140 is removable from the flexible blade 110 as shown in FIG. 24. In this embodiment, a slit 1421 is provided to closely receive the central portion 146 of the flexible blade 110. A releasable fastening means 118, and securing receptacle 1181 is utilized to removably secure the extended neck 142 of the tail fin 140 to the flexible blade 110.

Being able to remove the tail fin assembly 2070 from the footwear assembly 2050 enables the user to easily remove the portion of the swim fin apparatus 2000 Do which extends beyond the user's toes, for ease of walking on land, or for more compact transport or storage. Thus, the footwear assembly 2050 acts as footwear or a short swim fin similar to the embodiment 1400 in FIG. 9. Footwear assembly 2050 and tail fin assembly 2070 can be attached to one another with the stabilizing pins 1105 ensuring proper placement and stability during use. This footwear assembly 2050 and tail fin assembly 2070 serve to make the swim fin embodiment 2000 similar in function to the swim fin embodiment 1600 found in FIG. 11, and the swim fin apparatus 1000 found in FIG. 1.

This embodiment 2000 will allow the best of both embodiments, and the flexible blade 110 and tail fin assembly 2070 attach with less effort than similar arrangements in the prior art because the tail fin assembly 2070 is completely flexible in nature and doesn't have to endure the stresses created with a stiff blade connection. Other flexible blades 110 and tail fins 120 can also be interchanged in this embodiment 2000 along with different sizes and shapes for the channeling scoops 102 to allow the swimmer to adapt his swim fins for special operations, goals or swimming strengths and conditions.

In FIG. 13 and FIG. 14, the flow of water 400 is shown in dashed lines. Notice that the water moved by the foot-pocket 101 flows forward towards the toes and the flexible blade 110, or to the sides directional channeling curves 105 where it is captured by the channeling scoops 102 and channeled in the same direction to produce thrust. These views also give another perspective for seeing some of the complex curves possible in the channeling scoops 102 and their directional channeling curves 105 The direction of movement of the foot is noted by an arrow 500, with the flow of water denoted by a dashed line 400. This embodiment 1640 has a different tail fin 140 than the embodiment 1600 found in FIG. 11. This illustrates the ability to exchange items, such as the tail fin 140, or the channeling scoops 102 to vary the sizes and different shapes to suit the swimming styles, strengths, and swimming conditions. It is also within the scope of this disclosure, and the accompanying claims, to fabricate the swim fin apparatus 1000 disclosed herein as a single unibody construction, to reduce manufacturing costs and increase ease of use and reliability.

Notice how the water flow 400 passes through the path of least resistance 130 between the flexible blade 110 and the tail fin 140. When the extended neck 142 of the tail fin 140 is made flexible, a proper angle of attack between the tail fin 140 and the flow of water 400 will cause lift 600 as seen in FIG. 14. Lift 600 is caused when the water flows over the lifting surface 143 of the tail fin 140, which acts like a wing in both directions of water flow. The left side of the flexible blade 1112 is symmetrical with the right side of the flexible blade (unnumbered).

The scale or texture 115 formed by overlapping shapes, similar to scales, is seen in the enlarged view, and may be adapted to cover all surfaces, except the tail fin 140. The scale or texture 115 shown in FIG. 13, aids in the creation of small vortices used in this type of propulsion. The scale or texture 115 is an option and is not required. However, when used, the scale or texture 115 is designed to simulate the size and texture of a fish of approximately the same size as the swim fin apparatus 1640.

FIG. 14 shows a side view of the swim fin 1650, during an up-stroke foot motion shown with an arrow 500. This embodiment 1650 has two differences from the embodiment 1640 in FIG. 13. It has a larger channeling scoop 1022 and a directional channeling curve 1052 that can be attached to the foot-pocket 101 by a retaining pin 104. When retaining pin 104 is wedged into the retaining slot 1071 on the reinforcing side 1027 of the larger channeling scoop 1022, the channeling scoop 1022 is made secure. This larger channeling scoop 1022 is designed to extend around the back of the leg and foot 300. This embodiment would eliminate the need for a securing strap 103. This side view also shows the flexible nature of the flexible blade 110 where it bends immediately at the joints of the toes on the leg and foot 300.

In FIG. 15, FIG. 16, and FIG. 17 the dark arrow 550 shows the downward thrust of the foot in the down-stroke of the swimming motion. The swim fin apparatus 1640, shown in FIG. 15, includes curving lines to show the shape and curves of the relatively rigid parts of the channeling scoops 102, the foot-pocket 101, and the tail fin 140. The tips of the tail fin 148, the flexible blade 110 and the securing strap 103 can vary in flexibility by utilizing different materials for these component parts. The flexibility may also vary as a result of different thickness of the material used.

The water flow 400 in FIG. 16 and FIG. 17 is shown in dashed lines. The channeling scoop 102 channels and directs the flow of water 400 over the flexible blade 110 and the tail fin 140. Notice that the water 400 must flow a longer distance over the tail fin 140 because the lifting surface 143 of the symmetrical tail fin 140 with equal right side 128 and left side 127 making it symmetrical thus causes lift to occur on both sides equally. In the swim fin apparatus 1680 shown in FIG. 17, the tail curve 141 on the tail fin 140 helps to channel the flow of water to the center of the tail fin 140 creating lift 600. The channeling scoop 102 is permanently attached in this embodiment by rivets 106 or other known fastening means, to the reinforcing side 1027, which allows the channeling scoop 102 to be made of a dissimilar material to that of the foot-pocket 101.

In the swim fin apparatus 1680 shown in FIG. 17, the tail fin 140 is secured to the flexible blade 110 along the central axis, by any known securement means 145, such as a screw, bolt, rivet, allowing flexible blade 110 to be of dissimilar material to the tail fin 140. Alternately, the foot-pocket 108, the tail fin 140 and the flexible blade 110 may be fabricated as one unit.

Figure 18:
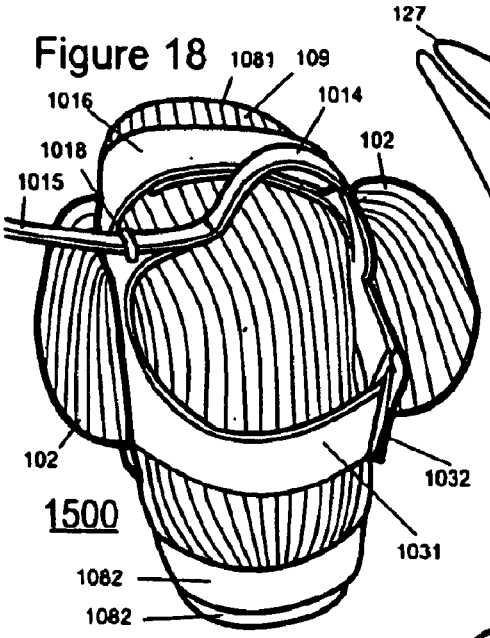
FIG. 18 is a top rear view of an embodiment of this invention, showing a sandal type of shoe with an articulated sole plate, which is used in conjunction with channeling scoops to aid in swimming.
Figure 20:
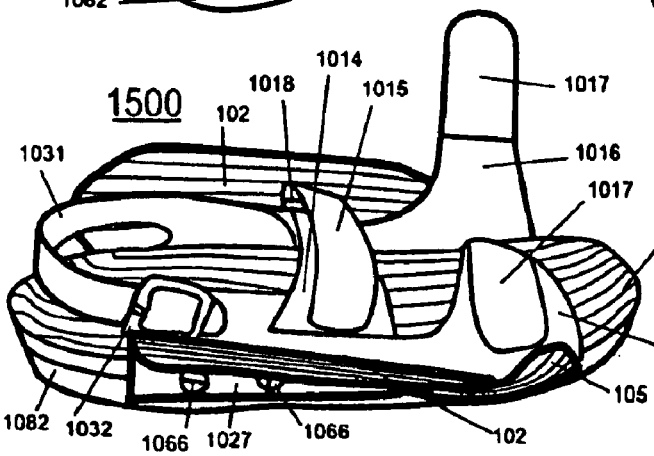
FIG. 20 is a perspective view of an embodiment of this invention, in which a sandal type of shoe with an articulated sole plate with channeling scoops.

FIG. 18 and FIG. 20 show different perspective views of a swim fin sandal apparatus 1500. The swim fin sandal apparatus 1500 is made of any appropriate waterproof material used in manufacturing sandals or swim fins. The material selected must be strong enough to support the weight of a user, and the pressures exerted by the channeling scoops 102 during swimming. In this embodiment 1500, the bottom instep strap 1014 and top instep strap 1015 preferably have a system of hooks and loops type fasteners 1017 attached to the bottom instep strap 1014 and to the top instep strap 1015, so that the hooks and loops type fasteners 1017 provide releasable and adjustable securement when the top instep strap 1015 and the bottom instep strap 1014 are engaged.

The instep strap loop 1018 will hold the two sides of the swim fin sandal apparatus 1500 together at the instep when the top instep strap 1015 is secured to the bottom instep strap 1014. Any known securement means may be used. In FIG. 18, the instep strap loop 1018 is shown not secured, and in FIG. 20 the instep strap loop is shown secured.

When the hooks and loops type fasteners 1017 on the opposing fore straps 1016 are adjustably secured together, the user's foot is secured to the swim fin sandal apparatus 1500. In conventional swim fins that have a stiff blade element extending beyond the toes, as shown in FIG. 3, these securing means would not be sufficient, because the forces involved in swimming with the prior art apparatus are too great. But in this embodiment, shown in FIG. 20, the swim fin sandal apparatus 1500, and in all other embodiments like this swim fin apparatus 1000, the forces are substantially reduced and spread across the entire foot (making this design more ergonomic), thus enabling the use of less severe means of securing the ergonomic swim fin apparatus 1000 to the leg and foot 300.

The rear securing strap 1031 is preferably secured against the heel of the foot by a rear securing strap 103. Any known fastening means, such as a buckle means 1032 (making the strap adjustable), hook, catch, button or hook and loop type fastening means 1017 may be used to adjustably secure the rear securing strap about the user's heel, and would correspond to the securing strap 103 in other embodiments 1250 such as the one in FIG. 19.

One major difference between this embodiment 1500 as shown in FIG. 18, and most swim fins presently in use and in the prior art (beyond the obvious difference of a channeling scoop 102) is that this embodiment 1500 preferably has a shaped insole 109, with an instep and shaped body to fit the sole of a user's foot more ergonomically. Left and right soles may be easily accommodated, thus allowing other activities, such as walking or running, in this swim fin sandal apparatus 1500. This would preferably entail the production of left and right versions of the swim fin sandal apparatus 1500, as is the case with most shoes and sandals now being worn.

In this swim fin sandal apparatus 1500, as shown in FIG. 18, the sole 1082 would also be made of a material (or layers of different materials) that would is provide padding for the foot to enable the swim fin sandal apparatus 1500 to be worn comfortably when walking or running, etc. Preferably, sole grooves 1081 are located on instep sole 109, to let the sole breathe in wet or hot environments.

When used, the sole grooves 1081 allow air get to the bottom of the foot. In FIG. 20, the opposing fore straps 1016 and hooks and loops type fasteners 1017 are seen open. In FIG. 20, the complex curves of the channeling scoop 102, and more particularly, the directional channeling curves 105 is shown. The reinforcing side 1027 of the channeling scoop 102 is preferably attached to the swim fin sandal embodiment 1500, with any known securement means 1066.

Figure 19:
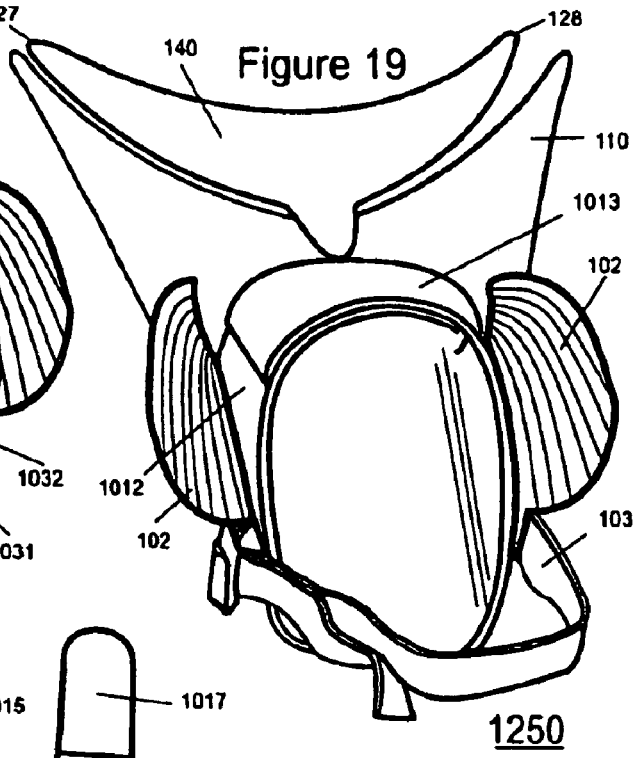
FIG. 19 is a perspective view of an embodiment of this invention, showing a swim fin with a safety strap, channeling scoops, flexible blade and tail fin, wherein the foot pocket is completely open.

In FIG. 19, the swim fin apparatus 1250 may be similar to other embodiments already described, with one exception. This swim fin apparatus 1250 is secured to the foot, in a manner similar to the embodiment 1500, shown in FIG. 18. However, a broader set of lower and upper securing flaps 1012, 1013 respectively would provide a temporary foot-pocket shown in FIG. 19 by the closed lower and upper securing flaps 1012 and 1013. This again could be achieved with simple hook and loop materials (with some relatively simple means of attachment to the securing flaps 1012, 1013 respectively.) This would provide two important advantages. First, the entire fin could be cast with a simple two part mold and thus reduce the cost and complexity of production. Second, the overlapping flaps would enable some adjustment in the size of the temporary foot-pocket, for better adjustment of the swim fin apparatus to the swimmer's foot.

Figure 21:
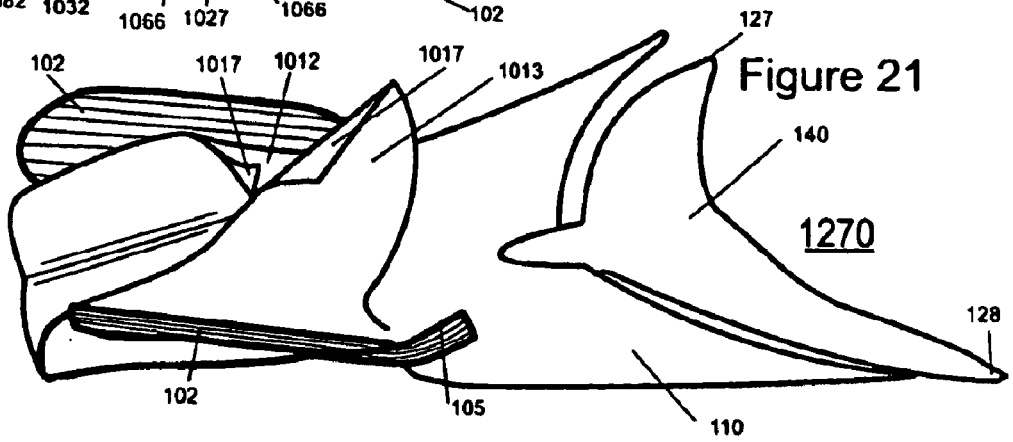
FIG. 21 is a perspective view of an embodiment of this invention, showing a swim fin with a foot pocket that can completely open, channeling scoops, a symmetrical flexible blade, and a symmetrical tail fin, without a safety strap.

As seen in the side view of FIG. 21, the swim fin apparatus 1270 shows the two securing flaps 1012 and 1013 in an open position. The hooks and loops type fasteners 1017 are preferably attached by any known means to the underside of the upper securing flap 1013. Preferably, hook and loop type fasteners 1017 are secured to the top of flap 1012 and to the top portion of the upper securing flap 1013, so that the flaps are releasably secured when pressed together.

On the underside of flap 1012, more hooks and loops type fasteners 1017 may be provided for multiple reasons. First, the hook and loop type fastener 1017 material would be more gentle and thus more ergonomic when positioned in relation to the top of the foot (not shown here) than a hard plastic material. Further, the use of the hook and loop type fastener 1017 can secure the instep sole 109 to the underside of securing flap 1012.

Hook and loop type fasteners 1017 means could also be used to attach the top of the ergonomic swim fin apparatus 1250 to existing boots/shoes. This would allow for very quick, easy, and adjustable entry and exit of the user's foot into the temporary foot-pocket. By stepping into the open foot-pocket created by pulling the two securing flaps 1012 and 1013 apart, the top of the swim boot/shoe equipped with hooks and loops type fasteners 1017 would quickly be secured to the swim fin apparatus 1270. After the upper securing flap 1013 is secured to the lower securing flap 1012, the user's foot within the hook equipped boot/shoe would be securely fastened to the swim fin apparatus 1270. Because the channeling scoop 102 decreases the pressure necessary for good swimming propulsion, and because it spreads that pressure over a wider area, the securing flaps 1012 and 1013 can be made of much thinner and more flexible material than prior art foot-pocket material. It should be noted that in this swim fin apparatus 1270, the need for a securing strap 103 at the back of the foot would be optional, limited or unnecessary.

Figure 22:
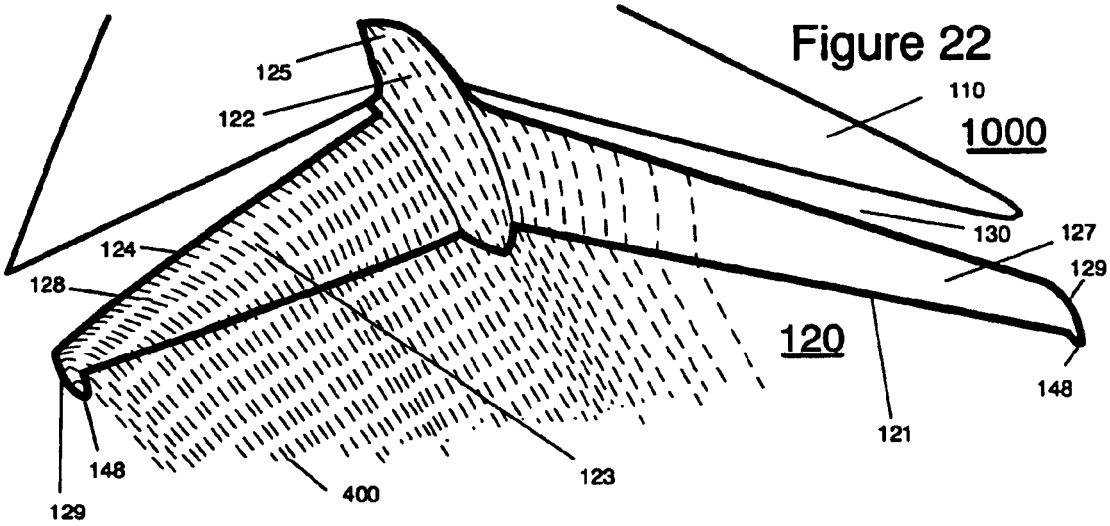
FIG. 22 is a rear view of an embodiment of this invention, in which a portion of the flexible blade is shown connected to the tail fin, with the flow of water across the symmetrical wing-like tail fin shown in dashed lines.

FIG. 22 shows a perspective view of part of a flexible blade 110 and tail fin 120, with the water flow 400 shown in dashed lines. Although the tail fin apparatus shown in FIG. 22 and FIG. 23 differ in some ways, they are substantially the same type of "wing" form where the symmetrical wings (where the left side 127 and the right side 128 are mirror images of each other) are straight in the embodiment 120 shown in FIG. 22, and curved in the embodiment 140 shown in FIG. 23.

Figure 23:
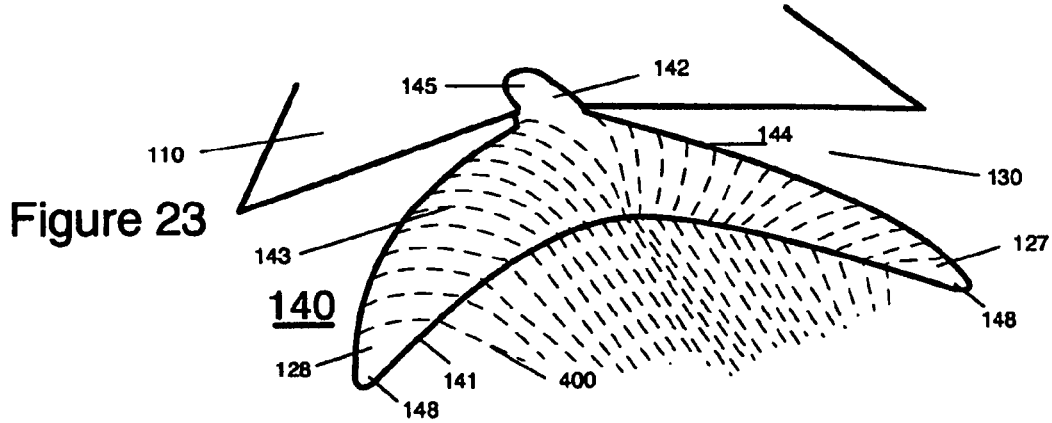
FIG. 23 is a perspective rear view of an embodiment of this invention, showing a portion of the flexible blade and connected tail fin, showing the laminar flow of water across the wing-like tail fin in dashed lines.

Each tail fin apparatus shown in FIG. 22 and FIG. 23 has a connecting point 125 and a securement means 145 respectively located along the longitudinal central axis of the swim fin apparatus 1000. The connecting point 125 or a securement means 145 can be a permanent attachment, a continuation of the flexible blade 110, or a releasable connecting means, 118, and 1181. In FIG. 22, the tail fin 120 has a leading edge 124 and a trailing edge 121 that extend in substantially straight lines across the tail fin 120. To decrease the drag created by vortices produced by moving through water, the tail fin edge 129 located at the distal sides of the tail fin 120, has a lifting surface that creates lift and channels the water towards the center of the tail fin 120. This pulls water away from the edge, and thus decreases the moving water that can be created as vortices and drag on the outer sides of the tail fin 120. The tip 148 of the tail fin edge 129 decreases in size and tapers to a point to enable the drag to be further reduced. The flow of water 400, shown by dashed lines, over the tail fin 120 illustrates the lifting surface 123 of the tail fin 120. An important part of this embodiment 120 is the attaching arm 122 which is centrally located on the longitudinal axis of the ergonomic swim fin apparatus 1000. The attaching arm 122 must have the strength of material to be flexed in opposite directions during each stroke the swimmer takes. The flexing is necessary to align the tail fin 120 to the flow of water 400 at a proper angle of attack so that lift is created to aid in swimming.

FIG. 23 shows a possible tail fin embodiment 140 where the leading edge 144 and the tail curve 141 are both curved towards the center of the tail fin 140. These lifting surfaces 143 serve to channel the water into a relatively small vector of water in the center of the tail fin 140. Again, this pulls the water away from the tips 148 of the tail fin 140 and reduces drag. The flow of water 400 shown in dashed line, also illustrates the lifting surface 143 of the tail fin 140. In both FIG. 22 and FIG. 23 the space between the flexible blade 110 and the tail fin 120 and 140 respectively is very important. The flexible blade 110 should assist in directing the flow of water over the lifting surface 123 and 143 of the tail fins 120 and 140 respectively.

FIG. 24, one means of attaching a tail fin 140 to a flexible blade 110 is illustrated. In this embodiment 140, the extended neck 142 extends symmetrically from the longitudinal axis of the tail fin 140 where the left side 127 and the right side 128 are mirror images of each other in a symmetrical configuration for securement to the central portion of the flexible blade 110. Any known securement means may be used. FIG. 24 has specialized adaptations including a tail fin slit 1421 and a securing receptacle 1181, for releasable securement the extended neck 142 of the tail fin 140 to the central longitudinal axis of the flexible blade 110.

A releasable fastener 118 is preferably located on both sides of the flexible blade 110. By having securing receptacles 1181 on both the lower and the upper portions of the attaching extended neck 142, these receptacles 1181 can slip over the securing hooks 1 18 to provide a simple, easy, and secure method of attaching the tail fin 140 to the flexible blade 110. Releasable securement of the tail fin 140 to the flexible blade 110 allows different styles, shapes and sizes of tail fins 140 to be selectively attached to a single flexible blade 110.

The specialized adaptation of a tail fin slit 1421 is preferably a thin membrane of the extended neck 142 which would act to form tension between the tail fin 140 and the flexible blade 110, to keep the security hook 118 secured in the securing receptacle 1181. This tension would only be great enough to keep the tail fin 120 from separating from the flexible blade 110 during use, but allow for the user to pull the securement means 145 away from the securing hook 118 when a change of tail fins 140 is desired.

Although specific features of this invention are shown in some drawings and not others, this is for convenience only as each feature may be combined with any or all of the other features in accordance with the invention.

Various modifications may be made to the disclosed ergonomic swim fin apparatus, and other modifications may be made by one of average skill in this art based upon the teachings herein. Such modifications are intended to fall within the scope of this patent application, and the appended claims.

Parts List

45 forces
50 stiff foot plate
55 Water pressure
101 foot-pocket
102 channeling scoops
103 securing strap
104 retaining pin

105 directional channeling curves
106 rivets
107 flaps
108 flexible blade sole
109 instep sole
110 flexible blade
112 left side of flexible blade
115 scale or texture
116 channeling groove
117 blade tips
118 releaseable fastener
120 tail fin
121 trailing edge (of tail fin 120)
122 leading edge (of tail fin 120)
123 lifting surface
124 leading edge (of tail fin 120)
125 connecting point
127 left side
128 right side
129 tail fin edge
130 Path of least resistance
140 tail fin
141 Tail curve (trailing edge)
142 extended neck (of tail fin 140)
143 lifting surface
144 Leading edge (of tail fin 140)
145 securement means
146 central portion (of the flexible blade)
148 tips
200 swim fin
210 reinforcing ribs
220 internal set of reinforcing ribs
250 foot pocket (or competitor swim fin)
300 leg and foot
400 water flow
500 arrow
550 dark arrow
600 lift
1000 swim fin apparatus
1001 Rigid Forebody
1002 Flexible Afterbody
1003 Tail
1005 Aquatic vehicle
1011 foot pocket grooves
1012 lower securing flaps
1013 upper securing flaps
1014 bottom instep strap
1015 top instep strap
1016 opposing fore straps
1017 hooks and loops type fasteners
1018 instep strap loop
1021 channeling scoop grooves
1022 larger channeling scoop
1027 reinforcing side
1031 Rear securing strap
1032 buckle means
1052 directional channeling curve
1066 securement means
1071 retaining slot
1081 sole grooves
1082 sole
1085 aperture
1101 flexible blade grooves
1105 pins
1111 catch
1112 hook
1181 securing receptacle
1200 swim fin apparatus
1201 tail fin grooves
1250 swim fin apparatus
1300 swim sandal/shoe
1400 swimming sandal shoe short swim fin apparatus
1421 tail fin slit
1500 swim fin sandal apparatus
1600 swim fin apparatus
1640 swim fin apparatus
1650 swim fin
1680 swim fin apparatus
2000 swim fin apparatus
2050 footwear assembly
2070 tail fin assembly

I claim:

1. A swim fin apparatus sized to fit about a user's foot, comprising:

a) a foot-pocket sized to receive a user's foot therein;

b) at least one securing strap to secure the foot-pocket to a user's foot;

c) opposing channeling scoops positioned on opposite sides of the foot-pocket; said channeling scoops positioned to channel water during the up-stroke and the down-stroke of the swim fin apparatus;

d) a flexible blade extends beyond the foot-pocket, to a distal end positioned on the longitudinal axis of the swim fin apparatus, and a tail fin is attached; and e) the flexible blade further comprising a curved trailing edge, and the tail fin comprising a complimentary curved leading edge positioned in spaced, complimentary alignment with the curved trailing edge of the flexible blade, whereby water flowing across the flexible blade passes over the wing-like tail fin to produce additional lift and thrust.

2. The swim fin apparatus of claim 1, wherein the tail fin comprising a centrally disposed extended neck portion and comprising left and right symmetrical fin portions, and the tail fin is releasably secured to the distal end of the flexible blade with a means of releasable securement.

3. The swim fin apparatus of claim 1, wherein the foot-pocket is in the form of footwear, with said opposing channeling scoops positioned on opposite sides of the footwear; said channeling scoops with directional channeling curves positioned to channel water during the up-stroke and the down-stroke of the swim fin apparatus.

4. The swim fin apparatus of claim 1, wherein said swim fin apparatus has a rigid forebody comprising said foot-pocket with a shaped insole and said channeling scoops, a flexible afterbody comprising said flexible blade and a symmetrical wing-like tail fin and whereby the shaped insole interfaces with the user's foot to assist in walking and swimming and the rigid forebody preferably comprises 40 percent to 80 percent of the length of the swim fin apparatus.

5. The swim fin apparatus of claim 1, wherein a plurality of small grooves form a non-stiffening pattern on a substantial portion of the outer surface of the swim fin apparatus whereby small vortices are produced in water to create less drag.

6. The swim fin apparatus of claim 1, wherein the foot-pocket and the channeling scoops use a releasable securement means to secure the flexible blade and the wing-like tail fin whereby ease of transport, storage and swimming are enhanced.

7. The swim fin apparatus of claim 1, wherein at least one pin and at least one complimentary aperture are positioned to engage when the portion of the flexible blade is selectively attached to the foot-pocket and the foot-pocket has an insole shaped to fit the sole of a user's foot with different left foot and right foot versions, and whereby these ergonomic insoles would provide padding, drainage and facilitate walking, running, and use.

8. A swim fin apparatus sized to fit about a user's foot, comprising:

a) a foot-pocket shaped to conform to a user's foot, and said foot pocket sized to extend beyond the user's foot to form a flexible blade;

b) at least one adjustable rear securing strap positioned to releasably secure the user's heel to the foot pocket;

c) opposing curved channeling scoops positioned on opposite sides of the foot pocket; said channeling scoops positioned to channel water during the up-stroke and the down-stroke of the swim fin apparatus, said curved channeling scoops upwardly inclined from proximity to the user's toes to proximity to the user's heel;

d) a flexible blade extending from the foot pocket, the flexible blade with an inclined trailing edge extending on each side of the longitudinal axis of the swim fin apparatus; and e) a tail fin with an inclined leading edge in spaced alignment in relation to the inclined trailing edge of the flexible blade; whereby water flowing across the flexible blade passes over the tail fin, to increase lift and thrust.

9. The swim fin apparatus of claim 8, wherein the foot-pocket is in the form of footwear having a toe end and a heel end, a first side and a second side, with said opposing curved channeling scoops positioned on the first and second sides of the footwear;

said curved channeling scoops positioned to channel water during the upstroke and the down-stroke of the swim fin apparatus, and said curved channeling scoops upwardly inclined from the toe end of the sandal towards the heel end of the sandal.

10. The swim fin apparatus of claim 8, wherein said tail fin has a centrally disposed extended neck portion and left and right symmetrical fin portions is releasably secured to the distal end of the flexible blade with a releasable securement means.

11. The swim fin apparatus of claim 8, wherein a plurality of small grooves form a non-stiffening pattern on a substantial portion of the outer surface of the swim fin apparatus whereby small vortices are produced in water to create less drag.

12. The swim fin apparatus of claim 8, wherein the foot-pocket has an insole shaped to fit the sole of a user's foot with different left foot and right foot versions.

* * * * *